US005879279A

United States Patent [19]

Berger et al.

[11] Patent Number: 5,879,279

[45] Date of Patent: Mar. 9, 1999

[54] CENTRIFUGAL SEPARATOR APPARATUS HAVING A VIBRATION SENSOR

[75] Inventors: Jeffrey L. Berger, Zionsville; Scott Behrens, Noblesville, both of Ind.

[73] Assignee: U.S. Centrifuge, Indianapolis, Ind.

[21] Appl. No.: 707,621

[22] Filed: Sep. 5, 1996

[51] Int. Cl.[6] ..... B04B 11/08; B04B 13/00

[52] U.S. Cl. ..... 494/7; 494/11; 494/55; 494/82; 494/84

[58] Field of Search ..... 494/1, 55, 7–9, 494/10, 11, 50–52, 82, 84; 210/144, 363; 68/12.06

[56] References Cited

U.S. PATENT DOCUMENTS

| | | | |
|---|---|---|---|
| 2,731,151 | 1/1956 | Hopper . | |
| 2,761,564 | 9/1956 | Tholl et al. . | |
| 2,895,023 | 7/1959 | Blum . | |
| 2,906,466 | 9/1959 | Hopper . | |
| 2,913,169 | 11/1959 | Wilsmann . | |
| 3,226,016 | 12/1965 | Couper et al. . | |
| 3,403,848 | 10/1968 | Windsor et al. . | |
| 3,424,375 | 1/1969 | Maurer | 494/11 |
| 3,582,934 | 6/1971 | Zumbulsen . | |
| 3,656,620 | 4/1972 | Larson et al. | 210/144 |
| 3,741,465 | 6/1973 | Lincoln . | |
| 3,861,584 | 1/1975 | Dudrey . | |
| 3,990,631 | 11/1976 | Schall . | |
| 4,046,317 | 9/1977 | Hein, Jr. . | |
| 4,070,290 | 1/1978 | Crosby . | |
| 4,155,503 | 5/1979 | Sears . | |
| 4,214,179 | 7/1980 | Jacobson et al. . | |
| 4,223,829 | 9/1980 | Bange . | |
| 4,522,620 | 6/1985 | Leister . | |
| 4,978,331 | 12/1990 | Luchetta et al. . | |
| 5,250,180 | 10/1993 | Chang . | |
| 5,342,282 | 8/1994 | Letourneur . | |
| 5,356,367 | 10/1994 | Carr . | |
| 5,362,293 | 11/1994 | Romanauskas . | |
| 5,454,777 | 10/1995 | Zeims et al. . | |

FOREIGN PATENT DOCUMENTS

| | | | |
|---|---|---|---|
| 2358803 | 6/1975 | Germany | 494/7 |
| 63-116762 | 5/1988 | Japan | 494/7 |
| 1-102000 | 4/1989 | Japan | 494/82 |

OTHER PUBLICATIONS

Brochure entitled "Basket Centrifuges Built for Tough Separation Applications", U.S. Centrifuge, Indianapolis, Indiana.

Spec Sheet entitled "Model A262", U.S. Centrifuge, Indianapolis, Indiana.

Spec Sheet entitled "Model A242", U.S. Centrifuge, Indianapolis, Indiana.

*Primary Examiner*—Charles E. Cooley

*Attorney, Agent, or Firm*—Woodard, Emhardt, Naughton, Moriarty & McNett

[57] ABSTRACT

A centrifugal separator apparatus for separating a composition to a substantially solid portion and a substantially liquid portion. A dual mode vibration sensor is located radially outward from a shaft utilized for rotating a bowl. The vibration sensor for sensing the radial vibration of the bowl during rotation. Upon the vibration sensor sensing radial vibration above a first predetermined threshold or a second predetermined threshold, a signal is sent to a controller that activates a D.C. brake or frequency inverter to stop the rotation of the bowl. Further, in another embodiment, the centrifugal separator includes a directing member within the bowl for directing the composition outwardly toward the wall of the bowl during rotation to increase the separation of the liquid and the solids.

27 Claims, 5 Drawing Sheets

CENTRIFUGAL SEPARATOR APPARATUS HAVING A VIBRATION SENSOR

BACKGROUND OF THE INVENTION

The present invention relates generally to the design and construction of a centrifugal separation apparatus for separating a composition into a substantially solid portion and a substantially fluid portion. More particularly, the present invention has one form wherein a high speed centrifugal separator utilizes a centrifugal clutch to couple a plow blade assembly to a bowl containing a contaminated fluid for centrifugal separation into solids and liquids. Thereafter, the centrifugal clutch is disengaged and the plow blade assembly is driven relative to the bowl to dislodge the solids adhered to the bowl.

It is well known that in a centrifugal separator the separation of the solids and liquids in a contaminated fluid is accomplished by pumping the contaminated fluid into a high speed rotating bowl. The high speed rotation of the bowl creates centrifugal gravitational forces that cause the contaminated fluid to be displaced radially outward against the bowl wall. Since the bowl is rotating at a high rotational speed the solids tend to adhere to the bowl wall, while the substantially purified liquid exits through a discharge opening.

The centrifugal separator bowl must be periodically cleansed to remove the solids adhered to the bowl during the separation process. Failure to maintain the bowl in a dynamically balanced state and/or not overloaded with solid deposits can result in problems, such as: premature wear and failure of bearings, bushings, and seals; inefficient solid and liquid separation; overloading of the bowl drive motor; and overloading of the plow blade assembly drive motor. Prior designers of centrifugal separators have generally incorporated a mechanical plow blade within the bowl to remove accumulated deposits in an attempt to minimize problems associated with an overloaded and/or unbalanced bowl.

In many prior centrifugal separators the mechanical plow blade assembly is actuated at predetermined time intervals. A litany of disadvantages stem directly from having the cleaning of the centrifugal separator bowl occurring only at predetermined time intervals. More specifically, one disadvantage is associated with the inevitable variations in solid content within the contaminated fluid than can lead to mistiming of when the bowl cleaning is needed. Results of the mistiming include the overloading of the bowl with solids because too must processing time has elapsed since the last actuation of the cleaning cycle, or the inefficient processing of the contaminated fluid because the apparatus is cleansed when small amounts of solids have accumulated within the bowl. Therefore, a centrifugal separator having a clean cycle that is activated at predetermined time intervals is generally ineffective in handling a process wherein the quantity of solids within the contaminated fluid varies.

Another disadvantage of many prior centrifugal separators relates to the speed at which the plow blade assembly is rotated relative to the bowl wall. Typically, in some prior art separators a brake is actuated to stop the plow blade assembly rotation so as to dislodge the particles accumulated on the bowl wall. The resulting interaction between the braked plow blade assembly and the rotating bowl causes the solids accumulated on the bowl wall to be dragged at a relatively high speed across the surface of the bowl wall. Often, the contaminated fluid contains abrasive particles that cause wear, erosion and other premature failure problems when dragged across the bowl surface.

Although the prior techniques of reducing bowl dynamic imbalance and overloading in centrifugal separators are steps in the right direction, the need for additional improvement still remains. The present invention satisfies this need in a novel and unobvious way.

SUMMARY OF THE INVENTION

One embodiment of the present invention contemplates a centrifugal separator, comprising: a bowl for receiving a composition of liquid and particles therein; a first drive coupled to the bowl for rotating the bowl during a high speed separation mode to substantially separate the liquid and particles; a member rotatable within the bowl during a cleaning period for dislodging the particles accumulated on the bowl; and, the bowl and the member being mechanically coupled together so as to prevent the relative movement therebetween during the separation mode.

Another embodiment of the present invention contemplates a centrifugal separator, comprising: a bowl for receiving a composition of liquid and particles therein; a first drive coupled to the bowl for rotating the bowl to substantially separate the liquid and particles; and a vibration sensor associated with the bowl for sensing the radial vibration of the bowl while the bowl is rotated by the drive.

Another embodiment of the present invention contemplates a centrifugal separator, comprising: a bowl for receiving a composition of liquid and particles therein, the bowl having a liquid discharge, a particle discharge and an outer wall member extending therebetween; a drive coupled to the bowl for rotating the bowl at high speed to substantially separate the liquid and particles therein; and an annular directing member positioned within and at one end of the bowl proximate the liquid discharge for directing the composition outwardly toward the wall member during the high speed rotation so as to increase the separation of the liquid and particles.

One object of one form of the present invention is to provide an improved centrifugal separator for separating a solid.

Related object and advantages of the present invention will be apparent from the following description.

DESCRIPTION OF THE PREFERRED EMBODIMENT

Figure 1:
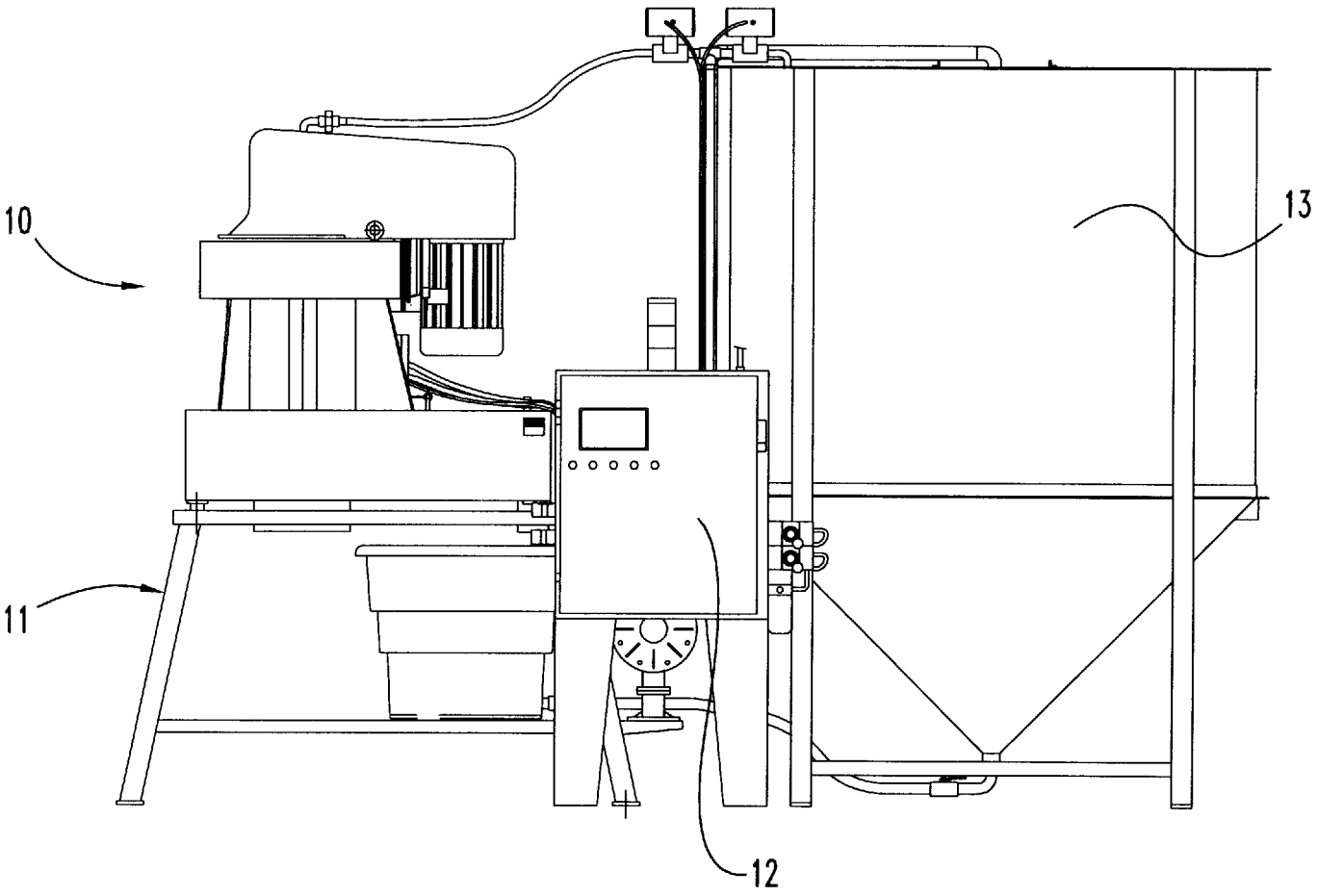
FIG. 1 is an illustrative side elevational view of a centrifugal separator of one form of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a high speed centrifugal separator 10 positioned on a stand 11 and disposed in fluid communication with a reservoir/tank 13. Further, the centrifugal separator 10 being coupled and in data communication with a controller 12. The reservoir/tank 13 being designed and constructed to hold a composition comprising fluids and solids. The composition of fluid in the preferred embodiment comprises a liquid and solid. In one form of the present invention the composition is pumped from the reservoir/tank 13 into the centrifugal separator 10 for subjection to high speed centrifugal gravitational separation in a bowl. The composition being separated into a substantially "pure" fluid portion and a substantially "pure" solid portion. However, other techniques for delivering the composition to the centrifugal separator are contemplated herein. In one form of the present invention, having an eighteen inch diameter bowl, the fluid flow rate through the separator 10 is in a range of about 30–70 gallons per minute. In another form of the present invention, having an eighteen inch diameter bowl, the fluid flow rate through the separator is in a range of about 40–60 gallons per minute, and it is more preferred that the flow rate be about 40 gallons per minute. An alternate form of the present invention, having a twelve inch diameter bowl, has a fluid flow rate through the separator in a range of about 5–20 gallons per minute. It is understood that other fluid flow rates are contemplated herein. Further, in another embodiment a plurality of centrifugal separators operate in series so that the fluid output from one separator is than processed in another separator.

Figure 2:
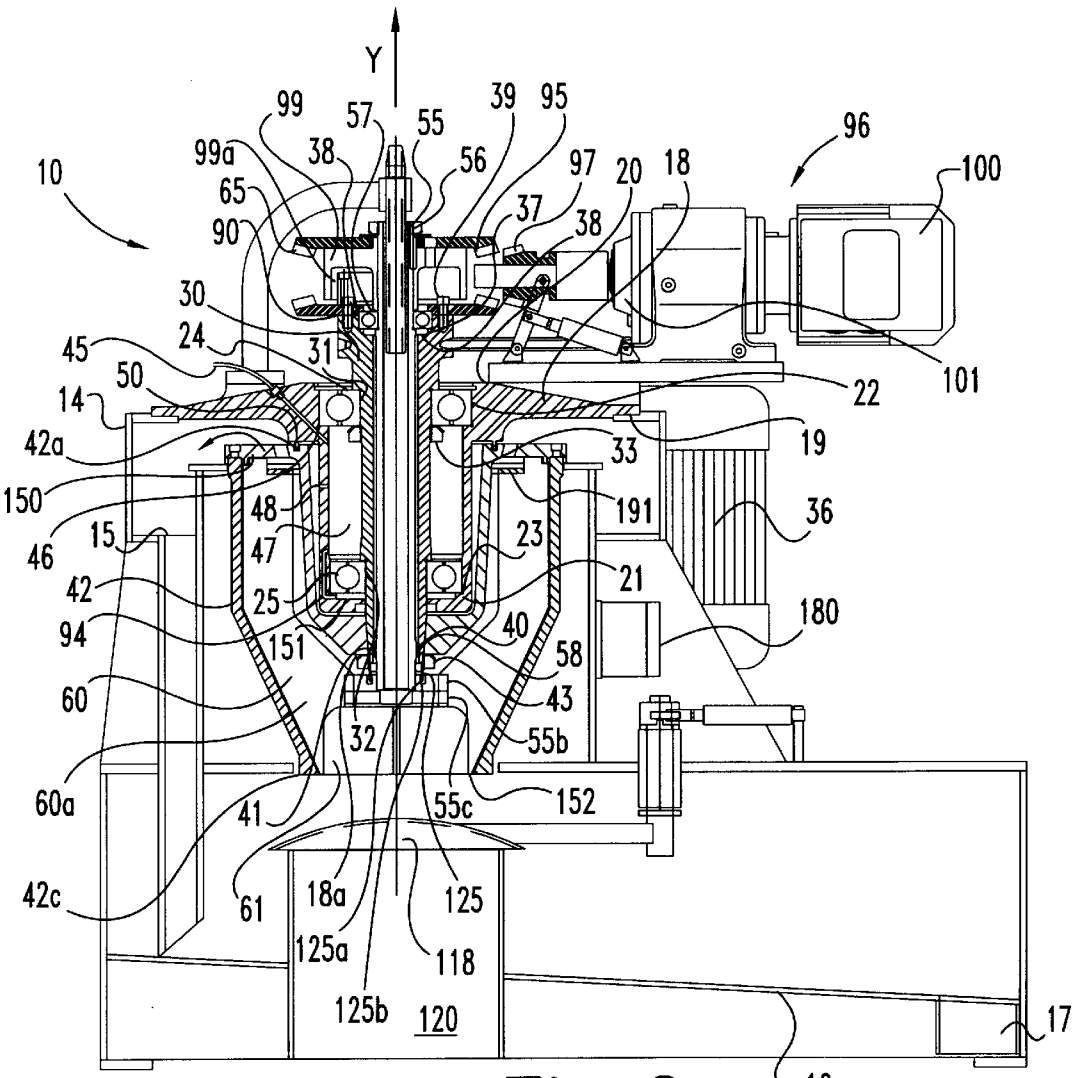
FIG. 2 is a side elevational view in section of the FIG. 1 centrifugal separator.

Referring to FIG. 2, there is illustrated a side elevational view in section of the high speed centrifugal separator 10. One form of the present invention contemplates a centrifugal separator having a twelve inch diameter bowl that rotates during the separation mode in a speed range of about 3,000–4,000 revolution per minute. Another form of the present invention contemplates a centrifugal separator having an eighteen inch diameter bowl that rotates in a speed range of about 2,000–3,000 revolutions per minute. The separation mode is a portion of the run cycle of the separator during which the bowl is revolved at substantially high speeds so that centrifugal forces can act on the material within the bowl to separate the solids and liquids. It is understood herein that other bowl sizes and rotational speeds are contemplated for the separation phase.

The centrifugal separator 10 includes a substantially rigid structural frame 14 for supporting components associated with the separator 10. Frame 14 is a fabricated metal structure that is generally known to those skilled in the art. Other frame designs that have the necessary structural integrity to allow the centrifuge components to rotate within specified tolerances are believed known to a person of ordinary skill in the art. A fluid collection system 15 is positioned within frame 14 for receiving the substantially pure fluid exiting the discharge 16. The fluid discharge 16 being located along the top 150 of the bowl 42, and in the preferred embodiment defining a substantially annular discharge opening. The fluid collection system 15 includes an inclined drain trough 16 which allows the fluid to flow by gravity to a centralized collection point 17.

An integrally formed main bearing housing 18 having a radially outward extending portion 19 which is coupled to the frame 14. In a preferred embodiment the main bearing housing 18 is formed of a cast steel and is substantially symmetric about a vertical centerline Y. A first bearing seat 22 is formed on a first end 20 of housing 18, and a second bearing seat 23 is formed on a second end 21 of housing 18. A first bearing 24 and a second bearing 25 are positioned within the first bearing seat 22 and the second bearing seat 23 respectively. Preferably bearings 24 and 25 are rolling element type bearings, and it is more preferred that bearings 24 and 25 be ball type bearing. The bearings 24 and 25 each having an outer bearing race that is fixedly coupled to the main bearing housing 18.

A main drive spindle 30 extending along the vertical centerline Y is positioned within and rotatable relative to the main bearing housing 18. Main drive spindle 30 is a substantially rigid shaft having a first bearing seat 31 and a second bearing seat 32 formed therein. The bearing seats 31 and 32 are sized and located so as to be received within the inner bearing races of bearing 24 and 25. A person of ordinary skill in the art realizes that the bearing 24 and 25 are coupled between the main drive spindle 30 and housing 18 to allow the main drive spindle 30 to efficiently rotate within the housing 18. A bearing keeper 33 is utilized to hold bearing 24 in place. Further, the main drive spindle 30 is coupled to a drive mechanism for revolving the main drive spindle 30 about the centerline Y. The main drive spindle 30 being revolved by the drive mechanism at a high speed during a high speed separation mode to substantially separate the liquid and particles. In the preferred embodiment the drive mechanism includes an electric motor 36.

In one form of the present invention the main drive spindle 30 includes an enlarged end 37 having a bearing seat 38 formed therein. Further, the enlarged end 37 includes a substantially planar annular ring 90 sized to receive a plurality of clutch pad member coupling pins 39 therein.

Main drive spindle 30 has an extended portion 40 that projects from the main bearing housing 18 and is sized to fit within a central aperture 41 of the centrifugal bowl 42. A lock ring 43 is coupled to the extended portion 40 to hold the bowl 42 and main drive spindle 30 together. The main drive spindle 30 and bowl 42 being locked together so there is no substantial relative motion therebetween. Further, in a preferred form of the present invention the bowl 42 being oriented such that it is rotatable around the vertical centerline Y.

A fluid conduit 45 is coupled to the main bearing housing 18 and is in fluid communication with an aperture 46 extending into the main bearing housing 18. The main bearing housing having an internal cavity 47. In a preferred embodiment the fluid conduit 45 receives a fluid flow of pressurized fluid for delivery to the internal cavity 47 of the main bearing housing 18. Preferably the fluid is a gas pressurized above ambient conditions, and it is more preferred that the gas is air. A pressurized fluid source, such as an air compressor (not illustrated) provides the source of pressurized fluid. In one embodiment the fluid flow parameters are seven cubic feet per minute of air at twenty pounds per square inch gage. A fluid discharge orifice 48 is formed through an outer wall of the bearing housing 18 and allows the discharge of fluid from within the internal cavity 47.

A passageway 94 is formed in the main bearing housing 18 adjacent the lower main bearing 25 for the passage of fluid between the internal cavity 47 and a related cavity 151. In a preferred embodiment the passageway 94 extends axially adjacent the outer race of bearing 25, (parallel to centerline Y) in the bearing housing 18. The passage of fluids between the internal cavity 47 and related cavity 48 prevents any substantial pressure differential across the bearing 25, thereby eliminating the drawing of lubricant out of the bearing 25. Further, the passage of fluid within the internal cavity acts to help cool the bearings 24 and 25 and prevent them from overheating.

Figure 3:
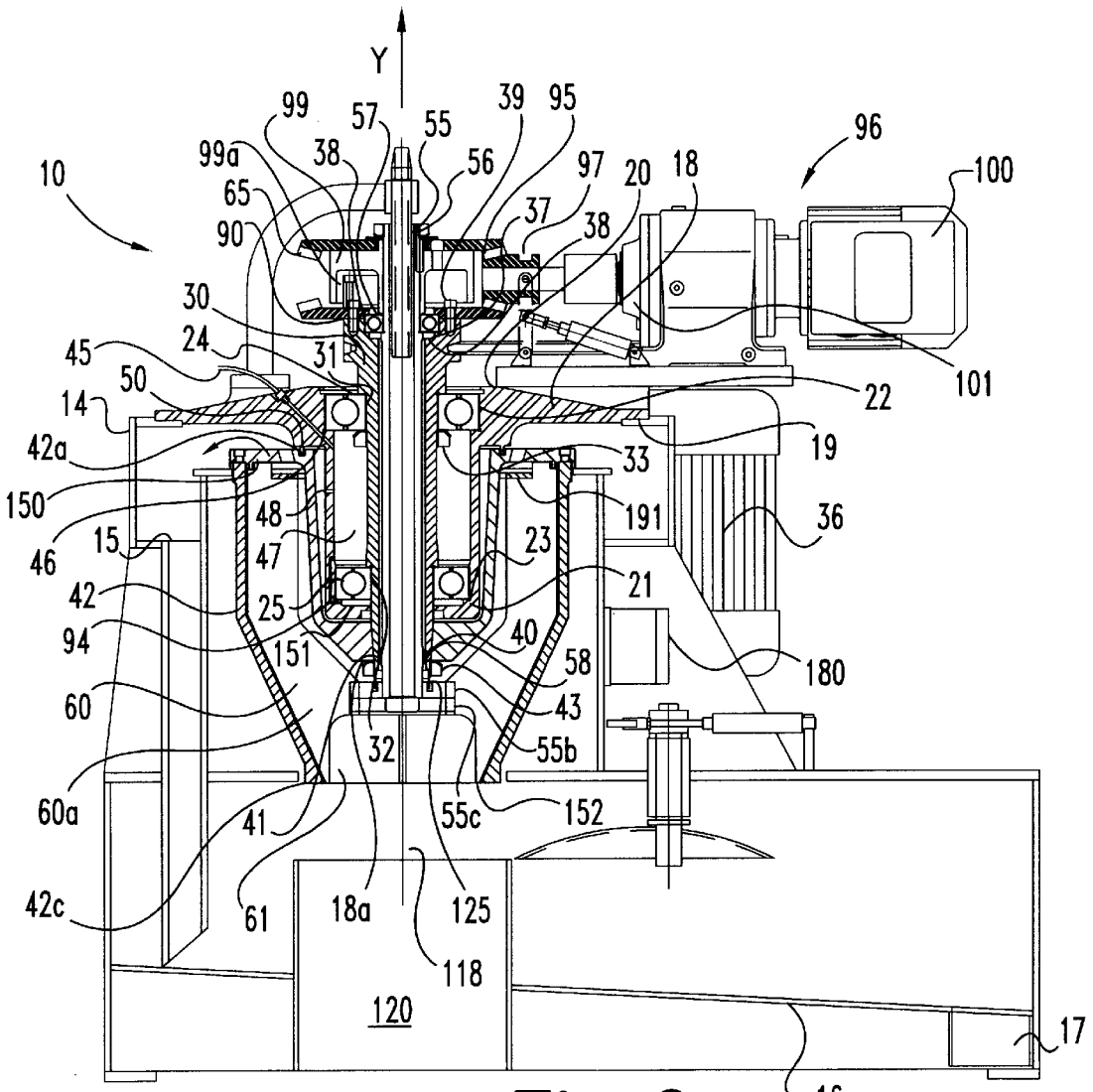
FIG. 3 is a side elevational view in section of the FIG. 1 centrifugal separator having a particle discharge chute open to accumulative particles when dislodged from a bowl comprising a portion of the separator.
Figure 3A:
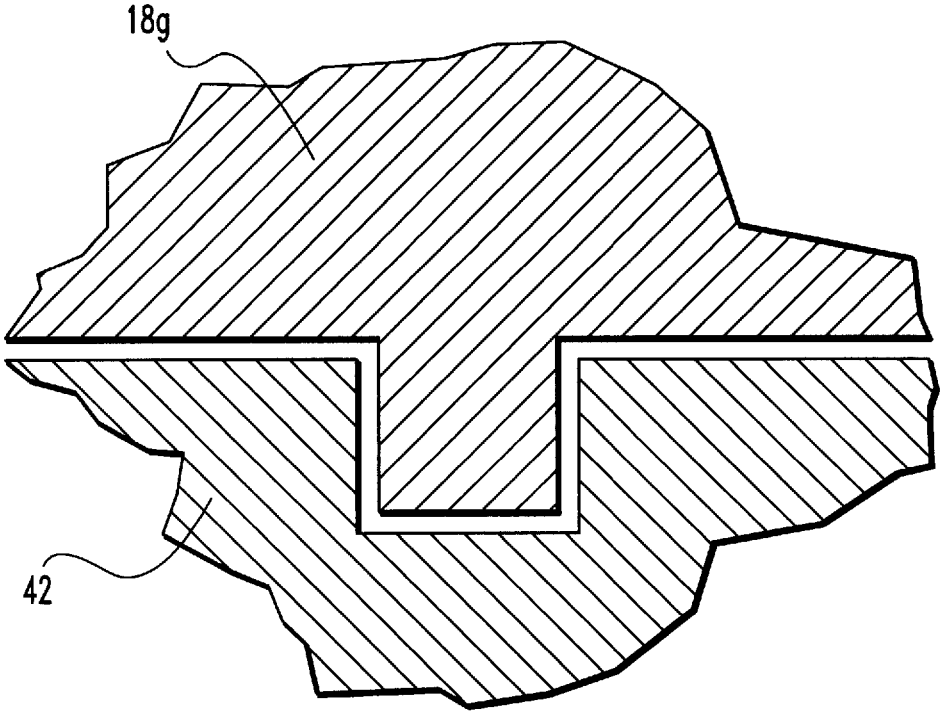
FIG. 3*a* is an enlarged sectional view of the labrynth seal comprising a portion of the FIG. 1 centrifugal separator.

A labrynth seal 50 is positioned between the main bearing housing 18 and a rim 42*a* of the bowl. The labrynth seal 50 forms a sliding substantially fluid tight annular seal between the bowl 30 and the main bearing housing 18 to block the flow of contaminants to the main bearing housing. With reference to FIG. 3*a*, there is illustrated a labrynth seal 50 having a ring 18*g* extending into a circular groove 42*b* formed in bowl 42. The ring 18*g* being formed in the bearing housing 18 and extending parallel to centerline Y. In the preferred embodiment the discharge of pressurized fluid from the fluid discharge orifice 48 provides an added barrier to any contaminants attempting to pass through the labrynth seal 50.

A substantially rigid plow blade drive shaft 55 extends through an aperture 56 formed through the main drive spindle 30. Plow blade drive shaft 55 being coupled to a rolling element type bearing 57 that is positioned within the bearing seat 38. In one form of the present invention the bearing 57 is a ball type bearing. A plow blade bushing 58, such as an oilite bushing, is fixedly attached to the wall of the main drive spindle 30 at the opposite other end of the aperture 56 and the shaft 55 is rotatably positioned within the bushing 58. The plow blade drive shaft 55 is rotatable on bearing 57 and bushing 58 within the aperture 56 formed in main drive spindle 30. The plow blade drive shaft 55 extends from the main bearing housing 18 to allow clearance between the bottom 18*a* of the housing 18 and a plow blade assembly 60. A labrynth seal 125 is coupled between the main drive spindle 30 and the plow blade drive shaft 55 to protect the lower main bearing 25 and bushing 58 by minimizing the passage of contaminants therebetween. Labrynth seal 125 being substantially similar to labrynth seal 50 in that it has a ring 125*a* extending into a groove 125*b*.

In the preferred embodiment the plow blade assembly 60 includes a plurality of plow blades 60*a* coupled to the plow blade drive shaft 55 at a central hub 61. In one embodiment the edge of the plow blades 60*a* being spaced a distance from the bowl 42, and in a more preferred form the edge being spaced 0.050 inches from the bowl. Other spacings are contemplated herein including a zero gap between the edge and the bowl surface. The plurality of plow blades 60 form a substantially rigid erosion resistant member that is rotatable within the bowl 42 during a cleaning mode to dislodge solids deposited on the bowl. The solid particles being received and accumulated on the bowl wall member during the separation mode. A preferred form of the plow blade assembly 60 has four plow blades 60*a* fixedly spaced about 90 degrees apart, and it is understood that plow blade assemblies having other quantities of plow blades is contemplated herein.

The bowl 42 having a solid discharge opening 152 located at its bottom end 42*c* that allows the dislodged solids to pass through a chute 120 into a material collection hopper (not illustrated). The chute 120 being located beneath the bowl 42 and substantially aligned with the centerline Y. Chute 120 having a mechanically actuated lid 118 that closes and uncloses access to the hopper.

A first bevel gear 65 is fixedly connected to the enlarged end 37 of the main drive spindle 30, and a second bevel gear 95 is coupled to the plow blade drive shaft 55. A drive 96 having a pinion gear 97 coupled thereto is moveable to engage the bevel gears 95 and 65 to drive the plow blade drive shaft 55 and main drive spindle 30 in counter-rotating directions. In the preferred embodiment the drive 96 includes an electric motor 100 and drive assembly 101. A pneumatic cylinder 102 is utilized to move the pinion gear 97 into and out of engagement with the bevel gears 95 and 65.

Figure 4A:
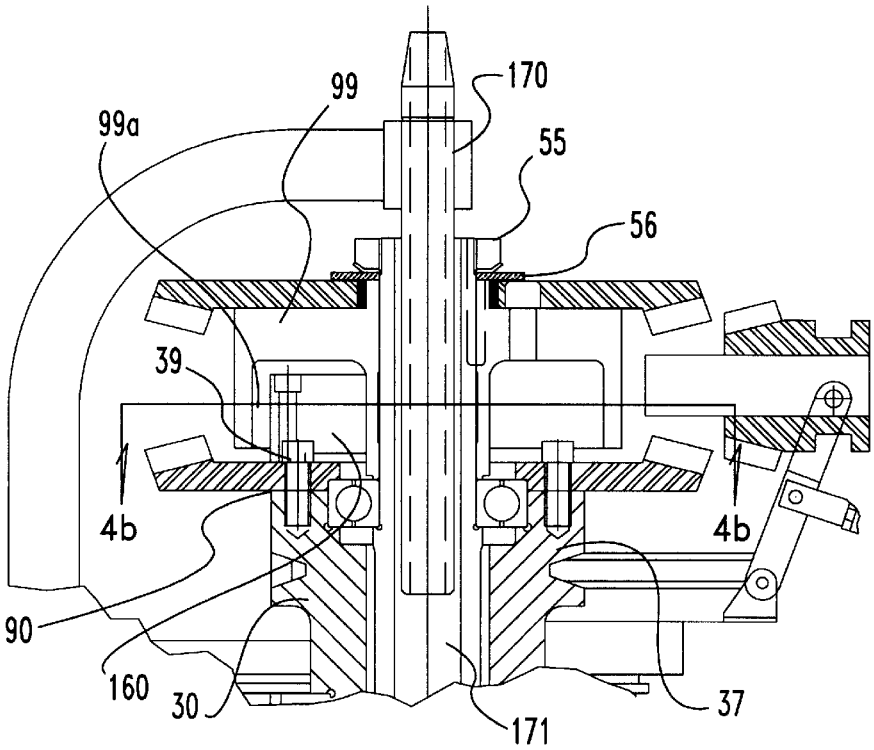
FIG. 4*a* is an enlarged partial sectional view of the centrifugal clutch comprising a portion of the centrifugal separator of FIG. 2.
Figure 4B:
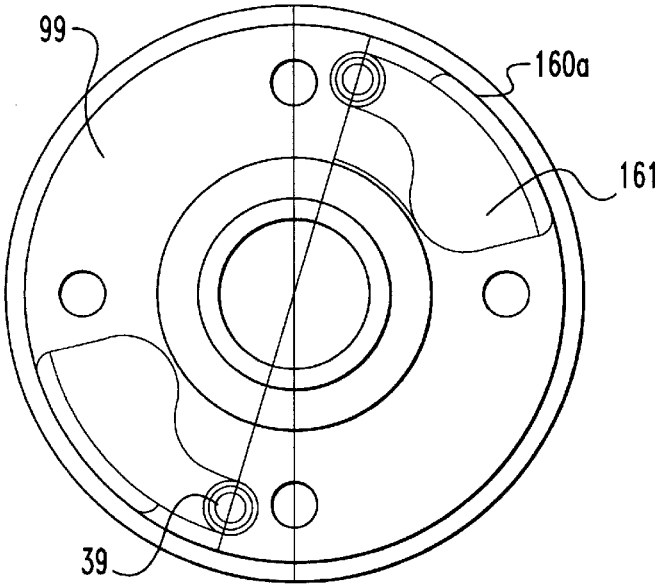
FIG. 4*b* is a illustrative sectional view taken along line 4B–4B of the centrifugal clutch which comprises a portion of the FIG. 2 centrifugal separator.

With reference to FIGS. 4*a* and 4*b* there is illustrated a substantially cylindrical hub 99 coupled to the plow blade drive shaft 55. The substantially cylindrical hub 99 having a cylindrical inner wall member 99*a* that is engagable by a plurality of clutch pad members 160 as the main drive rotates the main drive spindle 30. The plurality of clutch pad members 160 are rotatably mounted by the clutch pad coupling pins 39 to the planar annular ring 90 formed on the enlarged end 37 of the main drive spindle 30. In a preferred embodiment the plurality of clutch pad members 160 are connected to a clutch pad carrier 161. Clutch pad members 160 having a surface coefficient of friction greater than the surface coefficient of friction for the clutch pad engaging surface 99*a*. Clutch pad members 160 and clutch pad engaging surface 99*a* having other coefficients of friction are contemplated herein. Upon the main drive spindle 30 being rotated the clutch pad members 160 are thrown radially outward by centrifugal gravitational forces such that they engage the clutch pad engaging surface 99*a* of the hub 99. Clutch pad members 160 have a clutch face that is placed in contact with the clutch pad engaging surface of wall member 99*a* to mechanically couple the bowl 30 and plow blade drive shaft 55 together. The centrifugal clutch described above couples the main drive spindle 30 and the plow blade drive shaft 55 together and prevents the relative movement between the plow blade assembly 60 and the bowl 42 during the separation mode. The separation mode is generally known to those of ordinary skill in the art as the period in which the bowl is rotated at a relatively high speed to force the particles within the liquid and solid composition to be separated from each other.

A fluid delivery tube 170 passes into the centrifugal separator 10 to allow the delivery of contaminated fluid to be processed by the separator, the fluid passing through a central aperture 171 within the plow blade drive shaft 55 to the centrifugal bowl 42. The fluid exits the passageway in the drive shaft 55 via a plurality of apertures 55*c* formed in an impeller disk 55*b* coupled to the plow blade drive shaft 55 and into the bowl for separation.

A directing member 191 is positioned within bowl 42 for directing the movement of the fluid composition within the bowl radially outward toward the outer wall. In the preferred embodiment the directing member 191 is a substantially annular ring that is coupled to the top/rim end of the bowl 42. The ring extending radially outward from the inner wall of the bowl, so as to prevent the discharge of fluid proximate the inner wall of the bowl. The directing member forcing the fluid composition to be moved radially outward so that the solid particles are subjected to greater centrifugal forces.

Having described one form description of a centrifugal separator of the present invention the operation and control of the separator will now be described with use of FIGS. 1–4. In one form of the present invention the centrifugal separator processes the contaminated fluid in a processing cycle that includes running in a high speed separation mode, stopping the separation mode, and then operating a cleaning/bowl solid particle dislodging mode. It is preferred that the bowl 42 be run until full of solids to increase the efficiently of the operation. The bowl is brought to a stop and the plow blade assembly 60 is actuated to dislodge the accumulated solids from the bowl wall.

A vibration sensor 180 controls the operation of the centrifugal separator 10 during the high speed separation mode. In one embodiment the vibration sensor 180 being spaced radially outward from the main drive spindle 30. In the preferred embodiment the vibration sensor 180 is a dual output vibration sensor that is mounted to frame 14, and spaced radially outward from the bowl 42. In a more preferred embodiment the vibration sensor is a piezo-electric sensor, and in a most preferred embodiment the vibration sensor is a PCM/BETA model 440D vibratioh switch available from the manufacturer in Natick, Mass. Further, vibration sensor 180 is in data communication with controller 12 via a data communication pathway. The controller 12 receives the respective signals from the vibration sensor 180 to control the rotation of bowl 42 and the rotation of cleaning blade assembly 60. Upon receiving a signal from the sensor 180 that indicates that a threshold parameter has been exceeded a D.C. Brake or Frequency Inverter is actuated to stop the rotation of bowl 42, and to commence the clean mode wherein the plow blade drive shaft 55 with blade assembly 60 is rotated to dislodge accumulated material within the bowl. A larger unit, such as one having an eighteen inch, diameter bowl, will generally utilize the D.C. Brake which stops the bowl rotation in about thirty seconds. The smaller unit, such as one having a twelve inch diameter bowl, will generally utilize the Frequency Inverter to stop the bowl rotation in about two minutes. It is contemplated herein that the selection of the appropriate stopping device is within the realm of a person of ordinary skill in the art.

The vibration sensor 180 is located proximate the bowl 42 for sensing the radial vibration associated with the high speed rotation of the bowl 42. The vibration sensor 180 having: a first predetermined threshold and upon sensing radial vibration of the bowl above the first predetermined threshold a first signal is sent to stop the rotation of the bowl 42; and a second predetermined threshold and upon sensing radial vibration of the bowl above the second predetermined threshold a second signal is sent to stop the rotation of the bowl 42. Each of the first predetermined threshold and second predetermined threshold having a magnitude component and a time duration component. More specifically, the first predetermined threshold having first magnitude component and a first time duration component and the second predetermined threshold having a second magnitude component and a second time duration component. In the preferred embodiment the first magnitude component is greater than the second magnitude component and the first time duration component is less than the second time duration component.

In one form of the present invention the first predetermined threshold being designed to trigger a signal during an emergency or bowl dynamic imbalance condition, and the second predetermined threshold being designed to trigger a signal during a full bowl condition. In one form of the present invention the first predetermined threshold being set such that a radial vibration amplitude above 1.5 inches/per second would exceed the first magnitude component. Further, the time duration component of the first predetermined threshold being in the range of about two to fifteen seconds. Therefore, in order for the first predetermined threshold to be exceeded both the first magnitude component and first time duration component must be satisfied. In a more preferred embodiment of the present invention the first time duration component is in the range of about two-four seconds, and the first magnitude component is about 0.5 inches/per second. Since the second predetermined threshold is more closely related to the evenly filled full bowl state a lower magnitude component and longer time duration component are its constituent parts. The second predetermined threshold having a second magnitude component less than about 0.75 inches per second and a second time duration component in the range of about thirty–sixty seconds. In a more preferred embodiment the second predetermined threshold having a second magnitude component of about 0.25 inches per second and a second time duration component of about one minute.

In one form of the centrifugal separator 10 the second predetermined threshold is bypassed during an initial bypass period. However, it is understood that in other forms of the present invention their is no initial bypass period. The inventors have found it beneficial in certain applications that during the initial processing of contaminated fluids within bowl 42 to initially bypass the second predetermined threshold for a period of time. In one form of the present invention the bypass period is about five minutes.

The maximum time the separation mode is allowed to run is also time limited, so as to further safeguard the bowl 42 from becoming overfilled with solids separated from the contaminated fluid. In the preferred embodiment the time is limited by a timer device. An overcurrent sensor is utilized to protect the plow blade drive shaft motor. The overcurrent sensor is designed to prevent damage to the plow blade drive shaft motor in situations where the torque required to dislodge the particles adhering to the bowl is greater than the capacity of the plow motor. The overcurrent sensor is set to trip just above the full load amp rating of the plow motor. Upon the tripping of the overcurrent sensor a signal is sent to the controller to shut the plow motor down. After, a time delay the plow blade drive motor is restarted to rotate the plow blade drive shaft 55 and scrape blade assembly 60 in the opposite direction. The changing of direction will continue each time that the overcurrent sensor is tripped. When there has been a prolonged period of rotation in either direction with no tripping of the overcurrent sensor the control of the cleaning mode is done by the controller 12. More specifically, controller 12 controls the duration of rotation in a first clockwise direction, a second counterclockwise direction, a time delay between switching directions of rotation, and an overall rotation time. In one form of the present invention the prolonged rotation is about fifteen seconds, however other times are contemplated herein. Upon completion of the overall rotation time the pinion gear 37 is disengaged to stop the rotation of the plow motor drive shaft.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifugal separator, comprising:

a bowl for receiving a composition of liquid and solids therein;

a first motor coupled to said bowl for rotating said bowl to substantially separate the liquid and solids during a separation mode;

a plow blade rotatable within said bowl for dislodging solids accumulated within said bowl, said plow blade being rotatable relative to said bowl not during said separation mode;

a vibration sensor associated with said bowl for sensing radial vibration of said bowl while said bowl is rotated by said motor, and wherein said vibration sensor having a first predetermined threshold and a second predetermined threshold, and wherein said vibration sensor upon sensing radial vibration above either said first predetermined threshold or said second predetermined threshold sends at least one signal;

a controller in communication with said vibration sensor, said controller receiving said at least one signal from said vibration sensor to control said bowl rotation during said separation mode; and a stop device in communication with said controller, said controller activating said stop device to stop the rotation of said bowl upon receiving said at least one signal, said controller activating the rotation of said plow blade during a cleaning mode to clean said bowl.

2. The separator of claim 1, wherein said first predetermined threshold has a first magnitude component and said second predetermined threshold has a second magnitude component, and wherein said first magnitude component is greater than said second magnitude component.

3. The separator of claim 2, wherein said first predetermined threshold has a first time duration component and said second predetermined threshold has a second time duration component, and wherein said first time duration component is less than said second time duration component.

4. The separator of claim 3, wherein said first time duration component is in the range of about 2–15 seconds and said second time duration component is about sixty seconds.

5. The separator of claim 3, which further includes a bypass period wherein said second predetermined threshold is bypassed for an initial period following the commencement of processing of the composition of liquid and solids.

6. The separator of claim 5, wherein said bypass period is about five minutes.

7. The separator of claim 2, wherein said first magnitude component is less than about 1.5 inches/second and said second magnitude component is less than about 0.75 inches/second.

8. The separator of claim 7, wherein said first magnitude component is about 0.5 inches/second, and said second magnitude component is about 0.25 inches/second.

9. The separator of claim 1, wherein said plow blade rotates at a speed substantially less than the speed of said bowl during said cleaning mode.

10. The separator of claim 9, wherein the duration of rotation of said bowl being limited by a timer.

11. The separator of claim 1, wherein said stop device is a brake.

12. The separator of claim 1, wherein said stop device is a frequency inverter.

13. A centrifugal separator, comprising:

a bowl for receiving a composition of liquid and solids therein, said bowl having a liquid discharge, a particle discharge and an outer wall member extending therebetween;

a first motor coupled to said bowl for rotating said bowl to substantially separate the liquid and solids during a separation mode;

a directing member positioned within said bowl proximate said liquid discharge for directing said composition outwardly toward said wall member during rotation so as to increase the separation of the liquid and solids, said directing member remains stationary with respect to said bowl during the separation of the liquid and solids;

a plow blade rotatable within said bowl for dislodging solids accumulated within said bowl, said plow blade being rotatable relative to said bowl not during said separation mode;

a vibration sensor associated with said bowl for sensing radial vibration of said bowl while said bowl is rotated by said motor, and upon said vibration sensor sensing radial vibration above a first predetermined threshold said bowl rotation being stopped.

14. The separator of claim 13, wherein said directing member is a substantially annular ring, and wherein said bowl is symmetrical about a vertical centerline.

15. The separator of claim 13, wherein said vibration sensor is a dual output sensor.

16. The separator of claim 15, wherein said vibration sensor has a first predetermined threshold and a second predetermined threshold, said first predetermined threshold has a first magnitude component and said second predetermined threshold has a second magnitude component, and wherein said first magnitude component is greater than said second magnitude component, wherein said first predetermined threshold has a first time duration component and said second predetermined threshold has a second time duration component, and wherein said first time duration component is less than said second time duration component.

17. A centrifugal separator, comprising:

a motor;

a shaft coupled to said motor;

a frame including a member, said member having a portion of said shaft rotatable coupled thereto;

a bowl for receiving a composition of liquid and solids therein, said bowl coupled to said shaft and rotatable therewith to substantially separate the liquid and solids during a separation mode; and a dual output vibration sensor coupled to said frame and spaced radially outward from said shaft for sensing radial vibration of said bowl while said bowl is rotated.

18. The separator of claim 17, which further includes a controller, and wherein said vibration sensor having a first predetermined threshold and upon sensing radial vibration of said bowl above said first predetermined threshold a first signal is sent to said controller to stop the rotation of said bowl, and a second predetermined threshold and upon sensing radial vibration of said bowl above said second predetermined threshold a second signal is sent to said controller to stop the rotation of said bowl.

19. The separator of claim 18, wherein said first predetermined threshold is designed to trigger a signal in response to an emergency or a dynamic imbalance condition, and wherein said second predetermined threshold is designed to trigger a signal in response to a full bowl condition.

20. The separator of claim 17, wherein said bowl includes a wall member, and which further includes a directing member positioned within said bowl for directing the composition outwardly toward said wall member during rotation so as to increase the separation of the liquid and solids, and further including a scraper blade rotatable within said bowl for dislodging solids accumulated within said bowl.

21. The separator of claim 20, wherein said directing member remains stationary with respect to said bowl during the separation of the liquid and solids, and said vibration sensor is spaced radially outward from said wall member.

22. The separator of claim 21, wherein:

said bowl is symmetrical about a vertical centerline, and wherein said bowl is rotatable about said centerline; and wherein said vibration sensor includes a first predetermined threshold and a second predetermined threshold, and wherein said first predetermined threshold has a first magnitude component and said second predetermined threshold has a second magnitude component, and wherein said first magnitude component is greater than said second magnitude component, wherein said first predetermined threshold has a first time duration component and said second predetermined threshold has a second time duration component, and wherein said first time duration component is less than said second time duration component.

23. The separator of claim 22, wherein said first magnitude component is less than about 1.5 inches/second and said second magnitude component is less than about 0.75 inches/second, and wherein said first time duration component is in the range of about 2–15 seconds and said second time duration component is about sixty seconds.

24. A centrifugal separator, comprising:

a frame including a member;

a bowl for receiving a composition of liquid and solids therein, said bowl rotatably coupled with said member;

a motor coupled to said bowl for rotating said bowl relative to said frame so as to substantially separate the liquid and solids during a separation mode;

a plow blade assembly disposed within and rotatable relative to said bowl for dislodging material accumulated within said bowl, said plow blade being rotatable relative to said bowl not during said separation mode;

a vibration sensor coupled to said frame for sensing radial vibration of said bowl during said separation mode, and said vibration sensor is spaced radially from said bowl, said vibration sensor having a first predetermined threshold and a second predetermined threshold, and upon said vibration sensor sensing radial vibration above one of said first predetermined threshold and said second predetermined threshold said bowl rotation is stopped.

25. The separator of claim 24:

which further includes a controller for receiving at least a signal from said vibration sensor for controlling said bowl rotation during said separator mode; and wherein said controller activating a stop device to stop the rotation of said bowl upon receiving a signal associated with either said first predetermined threshold or said second predetermined threshold.

26. The separator of claim 25, wherein said stop device is one of a brake and a frequency inverter.

27. The separator of claim 24, wherein said vibration sensor is PCM/BETA model 440D vibration switch.

* * * * *